US006332587B1

(12) United States Patent
Möller et al.

(10) Patent No.: US 6,332,587 B1
(45) Date of Patent: Dec. 25, 2001

(54) PROCESS FOR THREADING MATERIAL WEB ONTO REEL AND DEVICE FOR PROCESS

(75) Inventors: Roland Möller, Herbrechtingen; Werner Leitenberger, Schlier; Jörg Maurer, Steinheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/422,240

(22) Filed: Oct. 21, 1999

(30) Foreign Application Priority Data

Oct. 22, 1998 (DE) ..... 198 48 806

(51) Int. Cl.[7] ..... B65H 19/28

(52) U.S. Cl. ..... 242/532.2; 242/526; 242/534; 242/541

(58) Field of Search ..... 242/523.1, 527, 242/541, 526, 542.3, 532.2, 534

(56) References Cited

U.S. PATENT DOCUMENTS

| | | | |
|---|---|---|---|
| 1,894,253 | | 1/1933 | McCarthy et al. . |
| 4,445,646 | * | 5/1984 | Karr et al. ..... 242/542.3 |
| 5,531,396 | | 7/1996 | Kinnunen et al. . |
| 5,590,577 | | 1/1997 | Ruf et al. . |
| 5,690,298 | | 11/1997 | Rück . |
| 5,842,664 | | 12/1998 | ÅKerlund . |
| 5,943,787 | | 8/1999 | Kilpiä et al. . |

FOREIGN PATENT DOCUMENTS

| | | |
|---|---|---|
| 9103749 | 8/1991 | (DE) . |
| 9017797 | 6/1992 | (DE) . |
| 9206844 | 9/1992 | (DE) . |
| 4401959 | 7/1994 | (DE) . |
| 658504 | 6/1995 | (EP) . |
| 820946 | 1/1998 | (EP) . |
| 98/39515 | 9/1998 | (WO) . |

* cited by examiner

*Primary Examiner*—John Q. Nguyen
(74) *Attorney, Agent, or Firm*—Greenblum & Bernstein, P.L.C.

(57) ABSTRACT

Process and apparatus for threading a material web onto a reel. The process includes guiding a beginning of the material web to be wound around the drum, directing blower air to keep the material web away from the reel, supplying the material web to a preparation station, and threading the reel with the material web. The apparatus includes a drum positioned to precede the reel, a blower bar arranged crosswise to a web travel direction and including at least one exit opening adapted to provide blower air, a blower supply device adapted to supply blower air to the blower bar, and a control unit adapted to control activation of the blower air.

43 Claims, 1 Drawing Sheet

PROCESS FOR THREADING MATERIAL WEB ONTO REEL AND DEVICE FOR PROCESS

CROSS-REFERENCE TO RELATED APPLICATIONS

The present application claims priority under 35 U.S.C. § 119 of German Patent Application No.198 48 806.8, filed Oct. 22, 1998, the disclosure of which is expressly incorporated by reference herein in its entirety.

BACKGROUND OF THE INVENTION

1. Field of the Invention

The present invention relates to a process for threading a material web onto a reel, e.g., in a paper machine, The being of the material web to be threaded is guided around a drum that precedes the reel and, before being threaded onto the reel, is supplied to a preparation station, e.g., a pulper. The invention also relates to a device for performing such a process.

2. Discussion of Background Information

Threading of a material web onto a reel is required, for example, at the beginning of a winding process to wind a beginning of the web onto an empty reel. Likewise, a threading process is required in the event of a web break to thread a new web beginning onto either a wound reel or an empty reel. For this purpose, the empty reel or the wound reel is placed onto the drum after the previously wound reel has been removed.

Before the beginning of the web is threaded, it is supplied to a pulper in which the threading tip of the material web is removed. The threading tip is thus discarded into the pulper immediately after being guided around the drum that precedes the reel. After the material web has widened out with its continuous disposal of it into the pulper, the material web is cut and only then is it threaded onto the empty or wound reel, One problem with the above-noted process is that the material web threads itself onto the reel before being cut. This problem occurs to a greater extent at high machine speeds.

Attempts have been made to solve this problem by embodying the drum preceding the reel as a suction drum, which produces a negative pressure within the drum that acts on the material web through corresponding openings in the drum to secure the material web against the drum. However, this arrangement can, to a large extent, prevent a self-threading of the material web onto the wound reel or the empty reel. Moreover, the negative pressure inside the drum makes it more difficult to remove the web for disposal into the pulper.

SUMMARY OF THE INVENTION

The present invention provides a process of the type generally discussed above, in which self-threading of the material web onto either a empty reel or a wound reel is prevented, to the greatest extent possible, without complicating the removal of the web from the drum preceding the reel. In addition, a suitable device for performing this process is disclosed Therefore, before being threaded onto the reel, the material web can be kept away from the reel via blower air, A device for performing the above-noted process can include a blower bar arranged cross-wise (laterally) to the web travel direction and having at least one exit opening for the blower air, a device for supplying blower air to the blower bar, and a control unit for controlling introduction of the blower air, By keeping the material web away from the wound reel or the empty reel via blower air, self-threading of the material web onto the wound reel or the empty reel can be effectively prevented without necessitating suction to the drum preceding the reel. In this manner, removal of the web from the drum can be facilitated, even though the blower air does not significantly influence the web removal.

The empty reel that is placed onto the drum or the wound reel that is pressed against the drum is acted upon with blower air that is directed counter to the web travel direction and downstream of a contact line of the drum and reel. Therefore, the blower air forms a type of air knife, which cuts between the material web and the empty reel or the wound reel to prevent the material web from self-threading onto the empty reel or the wound reel. It can be advantageous if the blower air is introduced at a flat angle, e.g., between approximately 15° and 45°, and preferably between approximately 20° and 35°, onto a circumferential surface of the empty reel or the wound reel.

According to another embodiment of the invention, the blower air can at least intermittently introduced across an entire width of the material web. This embodiment can prevent self-threading and the material web may be conveyed away from the empty reel or the wound reel in a continuous fashion.

According to another embodiment of the invention, the blower air may be at least intermittently introduced only in a partial region of the material web, e.g., in a vicinity of a threading tip. This arrangement can save blower air without increasing the danger of self-treading and without impairing the guidance of the material web.

According to another embodiment of the invention, the blower air can be automatically activated in a threading process, which can simplify the operation of the device. It may be preferable for the blower air to be activated in a time-delayed fashion at the beginning of the threading process, which can in turn result in a savings of blower air.

According to another embodiment of the invention, the blower air may be activated by a break control, e.g., in the event of a web a break, which can simplify the activation of the blower air.

According to another embodiment of the invention, the blower air may be introduced at a predetermined distance. The distance can be preferably set by at least one distance sensor. The action of the blower air can advantageously be adapted to the respective conditions by adjustment of the predetermined distance. For example, the condition of the material web and the web travel speed can be taken into account.

The use of a blower bar for performing the process according to the invention can be structurally inexpensive and at the same time particularly effective. Due to the ability of the blower bar to be moved between a blowing position, in which the blower bar is disposed particularly near the circumferential surface of the empty reel or the wound reel, and a retracted position, a suitable distance between the blower bar and the respective circumferential surface can be adjusted without impairing the normal operation of the machine.

According to another embodiment of the invention, a positioning device may be provided to positionally adjust the blower bar to a predetermined distance, e.g., between approximately 1 and 20 mm, preferably between approximately 2 and 5 mm, and most preferably approximately 3 mm, from the empty reel or the wound reel. In this connection, the positioning device may preferably include at least one distance sensor. The blower bar can be moved in a suitable fashion via the positioning device.

The positioning device can be activated, e.g., automatically, in the event of a web break, which can be detected, e.g., via a web tension roll. Preferably, the blower bar may be then moved by the positioning device to the predetermined distance from the empty reel or the wound reel, In a likewise manner, the blowing process can be triggered, e.g., in a time-delayed fashion, when the positioning device is activated, e.g., between approximately 5 and 30 s, preferably between approximately 10 and 25 s, and most preferably between approximately 15 and 20 s. This arrangement can simplify the use of the device according to the invention to prevent self-threading, and save blower air.

According to another embodiment of the invention, the blower bar can extend across the entire width of the material web, The advantage of this embodiment is that the entire material web can be acted on with blower air.

By providing at least one separately controllable blowing zone, the blower air can advantageously be applied only in particular regions of the material web. In this manner, the blower air can be applied only in the vicinity of the threading tip of the material web, which can save blower air.

The present invention is directed to a process for threading a material web onto a reel in an apparatus that includes a drum positioned to precede the reel. The process includes guiding a beginning of the material web to be wound around the drum, directing blower air to keep the material web away from the reel, supplying the material web to a preparation station, and threading the reel with the material web.

In accordance with another feature of the present invention, the preparation station is a pulper, According to another feature of the instant invention, the process can farther include one of placing an empty reel onto the drum and pressing a wound reel against the drum. A contact line can be formed between the drum and the one of the empty reel and the wound reel. The process may further include directing the blower air counter to the web travel direction, and downstream from the contact line, with respect to a web travel direction. Further, the blower air may be directed onto circumferential surface of the one of the empty reel and the wound reel at a flat angle. Still further, the flat angle is between approximately 15° and 45°, and preferably between approximately 20° and 35°.

According to a furthers feature of the invention, the process can also include actuating the blower air at least intermittently across an entire width of the material web.

In accordance with a still further feature of the instant invention, the process can also include actuating the blower air at least intermittently in a partial region of the material web. The partial region is in a vicinity of a threading tip.

In accordance with another feature of the present invention, the process may firer include automatically activating the blower air in a threading process, Moreover, the process can include activating the blower air at a time after a beginning of the threading process. The blower may be activated between approximately 5 and 30 s, preferably between approximately 10 and 25 s, and most preferably between approximately 15 and 20 s after the beginning of the threading process. Further, the apparatus can further include a break control and the process may further include activating the blower air in the event of a web break.

According to a further feature of the invention, the blower air may be positioned a predetermined distance from a circumferential surface of the reel. The predetermined distance may be between approximately 1 and 20 mm, preferably between approximately 2 and 5 mm, and most preferably approximately 3 mm. Further, the apparatus may further include at least one distance sensor and the process can further include setting the predetermined distance with the at least one distance sensor.

According to yet another feature of the invention, the material web can be a paper web.

The present invention is also directed to an apparatus for threading a material web onto a reel that includes a drum positioned to precede the reel, a blower bar arranged crosswise to a web travel direction and including at least one exit opening adapted to provide blower air, a blower supply device adapted to supply blower air to the blower bar, and a control unit adapted to control activation of the blower air.

According to another feature of the present invention, the blower bar can be mounted for movement between a blowing position and a retracted position. In the blowing position, the blower bar may be disposed near a circumferential surface of the reel.

According to still another feature of the instant invention, a positioning device can be adapted to position the blower bar at a predetermined distance from the reel. The blower bar may be positionable a predetermined distance of between approximately 1 and 20 mm, preferably between approximately 2 and 5 mm, and most preferably approximately 3 mm from the reel. The positioning device can include at least one distance sensor, which can be a photoelectric cell.

In accordance with a further feature of the invention, the positioning device may be automatically activatable in the event of a web break. The positioning device can be adapted to maintain the predetermined distance between the blower bar and the reel. The positioning device can be adapted to maintain the predetermined distance of between approximately 1 and 20 mm, preferably between approximately 2 and 5 mm, and most preferably approximately 3 mm between the blower bar and the reel. Further, the control unit can be adapted to trigger the blower air at a time after the positioning device is activated. For example, the control unit may be adapted to trigger the blower air between approximately 5 and 30 s, preferably between approximately 10 and 25 s, and most preferably between approximately 15 and 20 s after the positioning device is activated, In accordance with still another feature of the present invention, the blower bar may be positioned to extend across an entire width of the material web.

According to a still further feature of the instant invention, the blower bar may include at least one independently controllable blowing zone. The at least one independently controllable blowing zone can be adapted to act upon a threading tip of the material web.

In accordance with yet another feature of the present invention, the blower box may be positioned to direct the blower air on a circumferential surface of the reel at a flat angle. The flat angle can be between approximately 15° and 45°, and preferably between approximately 20° and 35°.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of a non-limiting example of an exemplary embodiment of the present invention, and wherein:

The FIGURE schematically illustrates a side view of a winding device that prevents a self-threading of the material web.

DETAILED DESCRIPTION OF THE PRESENT INVENTION

Figure 1:
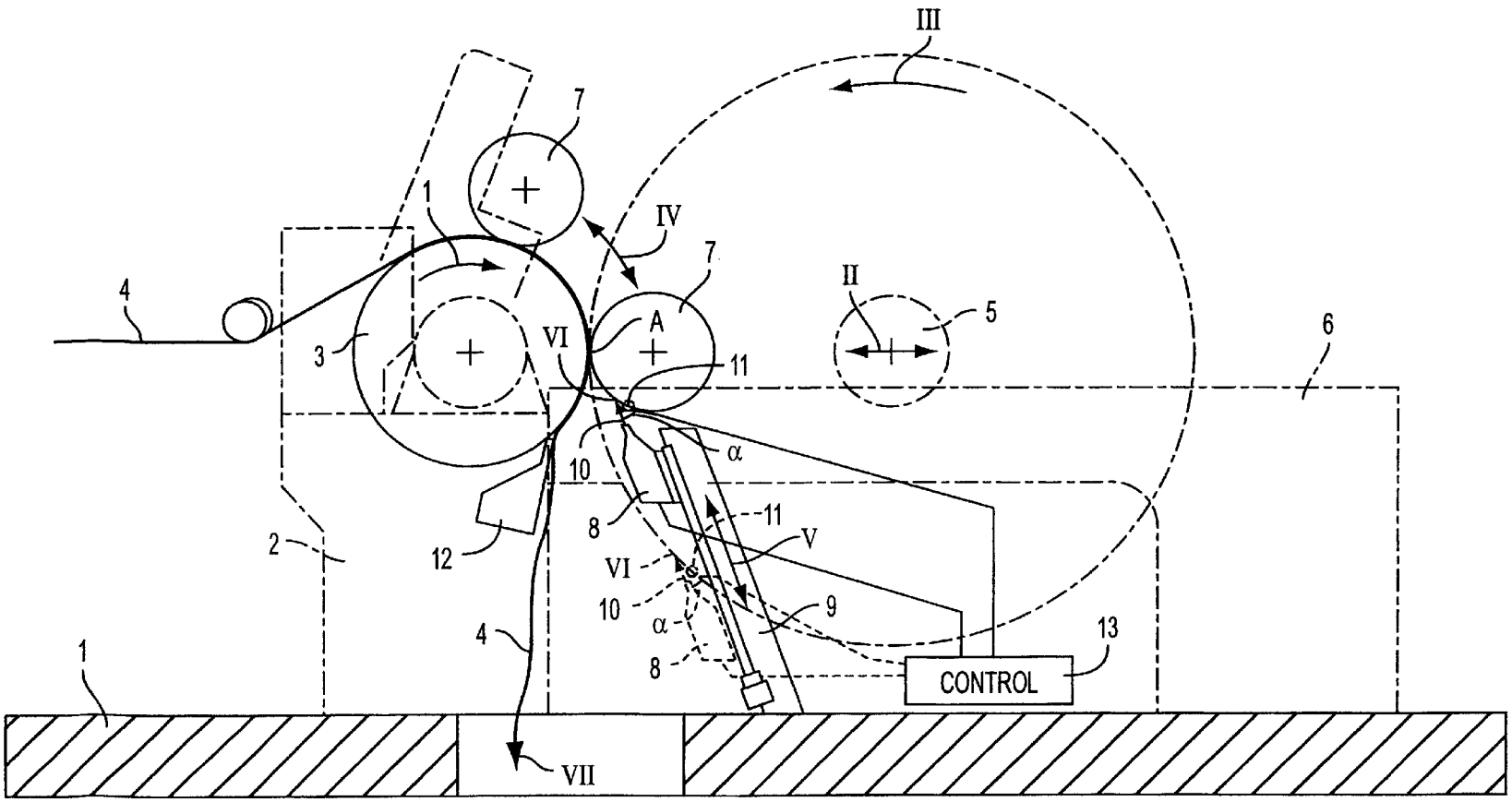

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The winding device shown in FIG. 1 includes a stand 2 disposed on a machine floor 1, and a carrying drum 3 rotatably supported on stand 2 for rotation in a direction of arrow I, The winding device is provided to wind a material web 4 onto a reel 5, which is rotatably supported in a stand 6 to rotate in a direction shown by arrow III. Further, reel 5 is positioned for movement on stand 6 relative to carrying drum 3, i.e., in the direction shown by arrow II. Stand 6 is also disposed on machine floor 1.

Reel 5, which is depicted with dot-and-dash lines as a wound reel, can be pressed against carrying drum 3. Solid lines are used to depict an empty reel 7 that can be placed onto carrying drum 3 during a reel change and thereafter guided around carrying drum 3 in a direction of arrow IV until positioned onto stand 6, where the full reel 5 was previously located during winding, In a vicinity between carrying drum 3 and reel 5 (or empty reel 7 in position on stand 6) and underneath a contact line A of reel 5 against carrying drum 3, a blower bar 8 can be positioned. Blower bar 8 may be arranged to extend crosswise to material web 4, and, preferably, across the entire width of material web 4. A guide unit 9 can be provided on which blower bar 8 can be mounted for movement in a direction of arrow V. Blower bar 8 can include air exit openings 10 that allow blower air to be blown out in a direction of arrow VI. Solid lines are used to depict a position of blower bar 8 when it is located near the circumferential surface of empty reel 7, i.e., in a blowing position. Air exit openings 10 of blower bar 8 can be positioned a predetermined distance from the circumferential surface of empty reel 7, e.g., between approximately 1 and 20 mm, preferably between approximately 2 and 5 mm, and most preferably approximately 3 mm. The distance can be set by, e.g., a distance sensor 11, such as a photoelectric cell. Dot-and-dash lines are used to depict a position of blower bar 8 when it is located near the circumferential surface of wound reel 5 and is spaced the predetermined distance from the circumferential surface by distance sensor 11. A completely retracted position of blower bar 8 is not shown in the Figure. In a particular embodiment of the present invention, distance sensor can be adapted to move together with and/or coupled to blower bar 8.

Blower bar 8, with air exit openings 10, can be arranged so that the blower air, according to arrow VI, strikes the circumferential surface of empty reel 7 or wound reel 5 at a flat angle a, e.g., between approximately 15° and 45°, and preferably between approximately 20° and 35°. The blower air, therefore, can function as an air knife to keep material web 4 away from the circumferential surface of empty reel 7 or wound reel 5. Material web 4 can be guided around carrying drum 3 and may be removed from it, e.g., with a doctor 12. The removed material web can be forwarded or supplied, in a direction of arrow VII, into a preparation station, e.g., a pulper (not shown), which is located underneath the winding device.

Distance sensor 11, together with a control device 13, can form a positioning device to move, e.g., automatically, blower bar 8 between the blowing position and the retracted position. In the event of a reel change or when a web break occurs, the positioning device can be automatically activated. For example, a web break can be 5 determined by a web tension roll (not shown). At the beginning of the threading process, blower bar 8 may be moved into its blowing position and the blower air can be activated, e.g., in a time-delayed fashion e.g., between approximately 5 and 30 s, preferably between approximately 10 and 25 s, and most preferably between approximately 15 and 20 s. In this regard, at the beginning of threading, it is possible to activate only a blowing zone of blower bar 8 associated with the threading tip of material web 4, In this manner, blower air is only exerted onto material web 4 at the threading tip. After material web 4 has widened out, blower air can be then introduced across the entire width of material web 4 via blower bar 8.

The threading process according to the present invention can include such features as, at the start of a threading process, the positioning device may be automatically activated and blower bar 8 can be moved into the blowing position, i.e., a predetermined distance, e.g., between approximately 1 and 20 mm, preferably between approximately 2 and 5 mm, and most preferably approximately 3 mm, from either the circumferential surface of empty reel 7 or the circumferential surface of wound reel 5, e.g., in the event of a web break. Material web 4, e.g., the threading tip, can be supplied to carrying drum 3, and the blower air from blower bar 8 can be time delay activated. The threading tip of material web 4 may be guided around carrying drum 3, and the guided threading tip can be removed from carrying drum 3 and supplied to the preparation station, e.g., pulper, while blower air is maintained.

Further, material web 4 guided around carrying drum 3 can widen out during the continuous disposal of material web 4 into, e.g., the pulper while blower air is maintained. Material web 4 can be cut, and the blower air can be deactivated. Moreover, blower bar 8 can be returned to the retracted position, At this point) material web 4, which is no longer acted upon by the blower air, can be threaded onto empty reel 7 or wound reel 5.

The blower air, which acts on material web 4 before the desired threading onto empty reel 7 or of wound reel 5, prevents a self-threading of material. Thus, negative pressure within carrying drum 3 is not required, and removal of material web 4 from carrying drum 3 with doctor 12 can be performed without any problems. The introduction of the blower air may be automatically controlled so that the entire process can be carried out in a simple manner. Blower bar 8 may be structurally inexpensive and, due to its mobility, does not interfere with the normal operation of the winding device.

It is noted that the foregoing examples have been provided merely for the purpose of explanation and are in no way to be construed as limiting of the present invention.

While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

1 machine floor
2 stand
3 carrying drum
4 material web
5 reel
6 stand
7 empty reel
8 blower bar
9 guide unit
10 air exit opening
11 distance sensor
12 doctor
13 control it
I rotation direction of 3
II movement direction of 5
III rotation direction of 5
IV pivot direction of 7
V movement direction of 8
VI blowing direction
VII removal direction
$\alpha$ blowing angle
A contact line of 3 and 5 or 3 and 7

What is claimed:

1. A process for threading a material web onto a reel in an apparatus that includes a drum positioned to precede the reel, the process comprising:

guiding a beginning of the material web to be wound around the drum;

directing blower air to keep the material web away from the reel;

supplying the material web to a preparation station;

threading the reel with the material web;

one of placing an empty reel onto the drum and pressing a wound reel against the drum, wherein a contact line is formed between the drum and the one of the empty reel and the wound reel; and directing the blower air counter to the web travel direction, and downstream from the contact line, with respect to a web travel direction.

2. The process in accordance with claim 1, wherein the preparation station is a pulper.

3. The process in accordance with claim 1, wherein the material web is a paper web.

4. The process in accordance with claim 1, wherein the blower air is directed onto circumferential surface of the one of the empty reel and the wound reel at a flat angle.

5. The process in accordance with claim 4, wherein the flat angle is between approximately 15° and 45°.

6. The process in accordance with claim 4, wherein the flat angle is between approximately 20° and 35°.

7. The process in accordance with claim 1, further comprising actuating the blower air at least intermittently across an entire width of the material web.

8. The process in accordance with claim 1, further comprising actuating the blower air at least intermittently in a partial region of the material web.

9. The process in accordance with claim 8, wherein the partial region is in a vicinity of a threading tip.

10. The process in accordance with claim 1, further comprising automatically activating the blower air in a threading process.

11. The process in accordance with claim 10, further comprising activating the blower air at a time after a beginning of the threading process.

12. The process in accordance with claim 11, wherein the blower is activated between approximately 5 and 30 s after the beginning of the threading process.

13. The process in accordance with claim 11, wherein the blower is activated between approximately 10 and 25 s after the beginning of the threading process.

14. The process in accordance with claim 11, wherein the blower is activated between approximately 15 and 20 s after the beginning of the threading process.

15. The process in accordance with claim 10, wherein the apparatus further includes a break control and the process further comprises activating the blower air in the event of a web break.

16. The process in accordance with claim 1, wherein the blower air is positioned a predetermined distance from a circumferential surface of the reel.

17. The process in accordance with claim 16, wherein the predetermined distance is between approximately 1 and 20 mm.

18. The process in accordance with claim 16, wherein the predetermined distance is between approximately 2 and 5 mm.

19. The process in accordance with claim 16, wherein the predetermined distance is approximately 3 mm.

20. The process in accordance with claim 16, wherein the apparatus firer includes at least one distance sensor and the process further comprises setting the predetermined distance with the at least one distance sensor.

21. An apparatus for threading a material web onto a reel, comprising:

a drum positioned to precede the reel;

a blower bar arranged cross-wise to a web travel direction and including at least one exit opening adapted to provide blower air;

a blower supply device adapted to supply blower air to said blower bar; and a control unit adapted to control activation of the blower air, wherein said blower bar is arranged to direct the blower air to keep the material web away from the reel.

22. The apparatus in accordance with claim 21, wherein said blower bar is positioned to extend across an entire width of the material web.

23. The apparatus in accordance with claim 21, wherein said blower bar is mounted for movement between a blowing position and a retracted position, and wherein, in the blowing position, said blower bar is disposed near a circumferential surface of the reel.

24. The apparatus in accordance with claim 21, further comprising a positioning device adapted to position said blower bar at a predetermined distance from the reel.

25. The apparatus in accordance with claim 24, wherein said blower bar is positionable a predetermined distance of between approximately 1 and 20 mm from the reel.

26. The apparatus in accordance with claim 24, wherein said blower bar is positionable a predetermined distance of between approximately 2 and 5 mm from the reel.

27. The apparatus in accordance with claim 24, wherein said blower bar is positionable a predetermined distance of approximately 3 mm from the reel.

28. The apparatus in accordance with claim 24, wherein said positioning device comprises at least one distance sensor.

29. The apparatus in accordance with claim 28, said at least one distance sensor comprising a photoelectric cell.

30. The apparatus in accordance with claim 24, wherein said positioning device is automatically activatable in the event of a web break.

31. The apparatus in accordance with claim 30, wherein said positioning device is adapted to maintain the predetermined distance between said blower bar and the reel.

32. The apparatus in accordance with claim 31, wherein said positioning device is adapted to maintain the predetermined distance of between approximately 1 and 20 mm between said blower bar and the reel.

33. The apparatus in accordance with claim 31, wherein said positioning device is adapted to maintain the predetermined distance of between approximately 2 and 5 mm between said blower bar and the reel.

34. The apparatus in accordance with claim 31, wherein said positioning device is adapted to maintain the predetermined distance of approximately 3 mm between said blower bar and the reel.

35. The apparatus in accordance with claim 30, wherein said control unit is further adapted to trigger the blower air at a time after said positioning device is activated.

36. The apparatus in accordance with claim 35, wherein said control unit is adapted to trigger the blower air between approximately 5 and 30 s after said positioning device is activated.

37. The apparatus in accordance with claim 35, wherein said control unit is adapted to trigger the blower air between approximately 10 and 25 s after said positioning device is activated.

38. The apparatus in accordance with claim 35, wherein said control unit is adapted to trigger the bower air between approximately 15 and 20 s after said positioning device is activated.

39. The apparatus in accordance with claim 21, said blower bar comprising at least one independently controllable blowing zone.

40. The apparatus in accordance with claim 39, said at least one independently controllable blowing zone is adapted to act upon a threading tip of the material web.

41. The apparatus in accordance with claim 21, wherein said blower bar being positioned to direct the blower air on a circumferential surface of the reel at a flat angle.

42. The apparatus in accordance with claim 41, wherein the flat angle is between approximately 20° and 35°.

43. The apparatus in accordance with claim 41, wherein the flat angle is between approximately 15° and 45°.

* * * * *